US005338125A

United States Patent [19]

Forsse et al.

[11] Patent Number: 5,338,125

[45] Date of Patent: Aug. 16, 1994

[54] MODULAR BOOK BINDER

[76] Inventors: Earl K. Forsse; Janis R. Forsse, both of 34341 Amber Lantern St., Dana Point, Calif. 92629-3011

[21] Appl. No.: 82,288

[22] Filed: Jun. 24, 1993

[51] Int. Cl.[5] ..... B42F 13/32

[52] U.S. Cl. ..... 402/46; 402/52; 402/79; 281/34; 206/472

[58] Field of Search ..... 206/387, 472; 402/46, 402/79, 45, 48, 52, 56, 54, 62; 281/34–37

[56] References Cited

U.S. PATENT DOCUMENTS

| | | | |
|---|---|---|---|
| 758,292 | 4/1904 | Ayres . | |
| 1,101,780 | 6/1914 | Blaylock . | |
| 1,689,401 | 10/1928 | McChesney | 402/62 |
| 1,763,075 | 6/1930 | Unger | 402/45 |
| 1,888,020 | 11/1932 | Warner, Jr. | 402/45 X |
| 1,960,280 | 5/1934 | Ritzinger | 402/46 |
| 1,999,734 | 4/1935 | McCleary | 402/46 |
| 2,472,969 | 6/1949 | Guinane . | |
| 3,734,634 | 5/1973 | Fenston . | |
| 4,002,355 | 1/1977 | Sendor | 206/472 X |
| 4,113,394 | 9/1978 | Giulie | 402/46 |
| 4,730,950 | 3/1988 | Ominato . | |
| 5,161,907 | 11/1992 | Byrne | 206/472 X |
| 5,263,865 | 11/1993 | Zipf | 206/387 X |

FOREIGN PATENT DOCUMENTS

| | | | |
|---|---|---|---|
| 2107125 | 8/1978 | Fed. Rep. of Germany | 402/48 |
| 834640 | 11/1938 | France | 402/46 |

*Primary Examiner*—Mark Rosenbaum
*Assistant Examiner*—Frances Han
*Attorney, Agent, or Firm*—Kelly, Bauersfeld & Lowry

[57] ABSTRACT

A modular binder is provided for quickly and easily binding a sheaf of papers to form a book. The modular binder comprises a pair of cover modules each including a cover leaf hinged to a spine segment, wherein the spine segments are identical and are adapted to interfit in face-to-face relation to retain the sheaf of papers. A spine lock clip is provided to interconnect the spine segments with a variable spacing according to the thickness of the paper sheaf. Auxiliary communication and/or entertainment modules such as an audio cassette player, one or more audio cassettes, etc., can be mounted onto one or both cover leaves of the two cover modules.

23 Claims, 4 Drawing Sheets

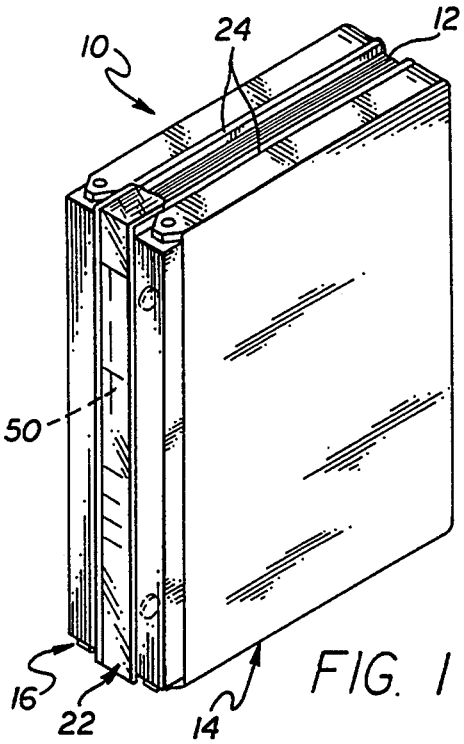
FIG. 1
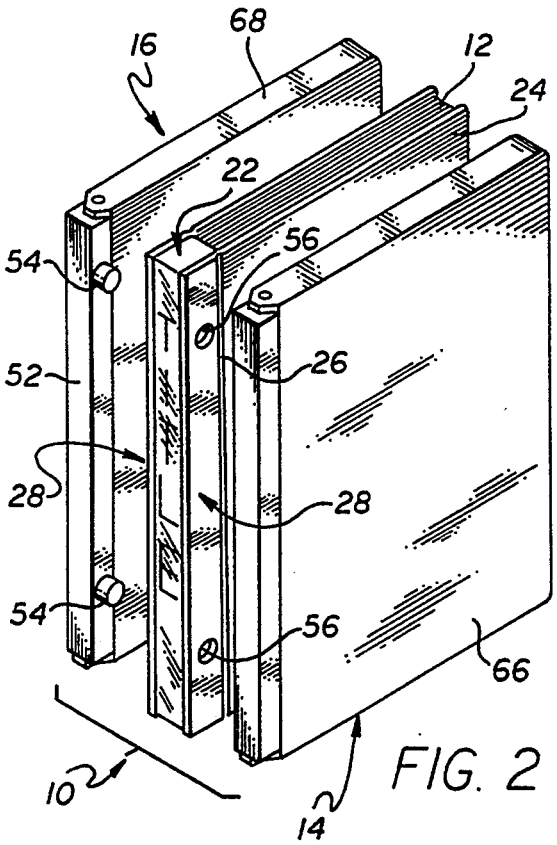
FIG. 2
FIG. 5
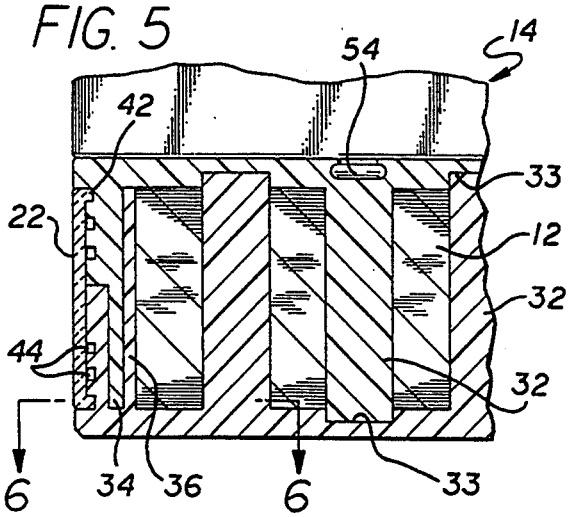
FIG. 7
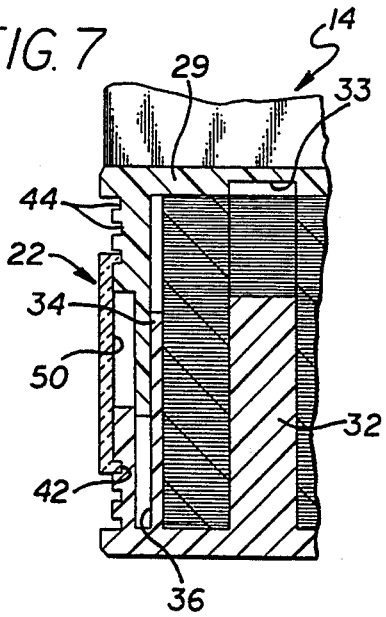
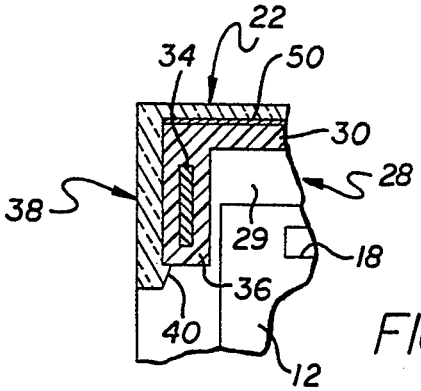
FIG. 6

FIG. 4
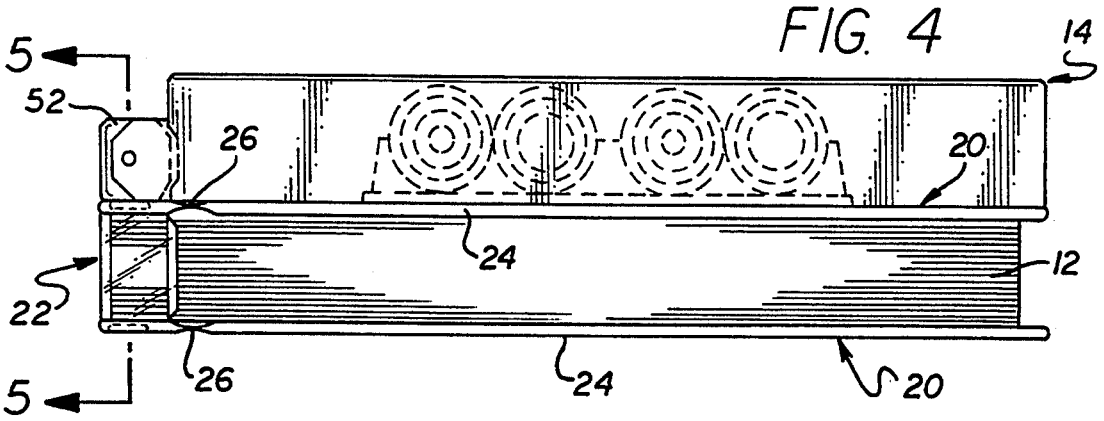
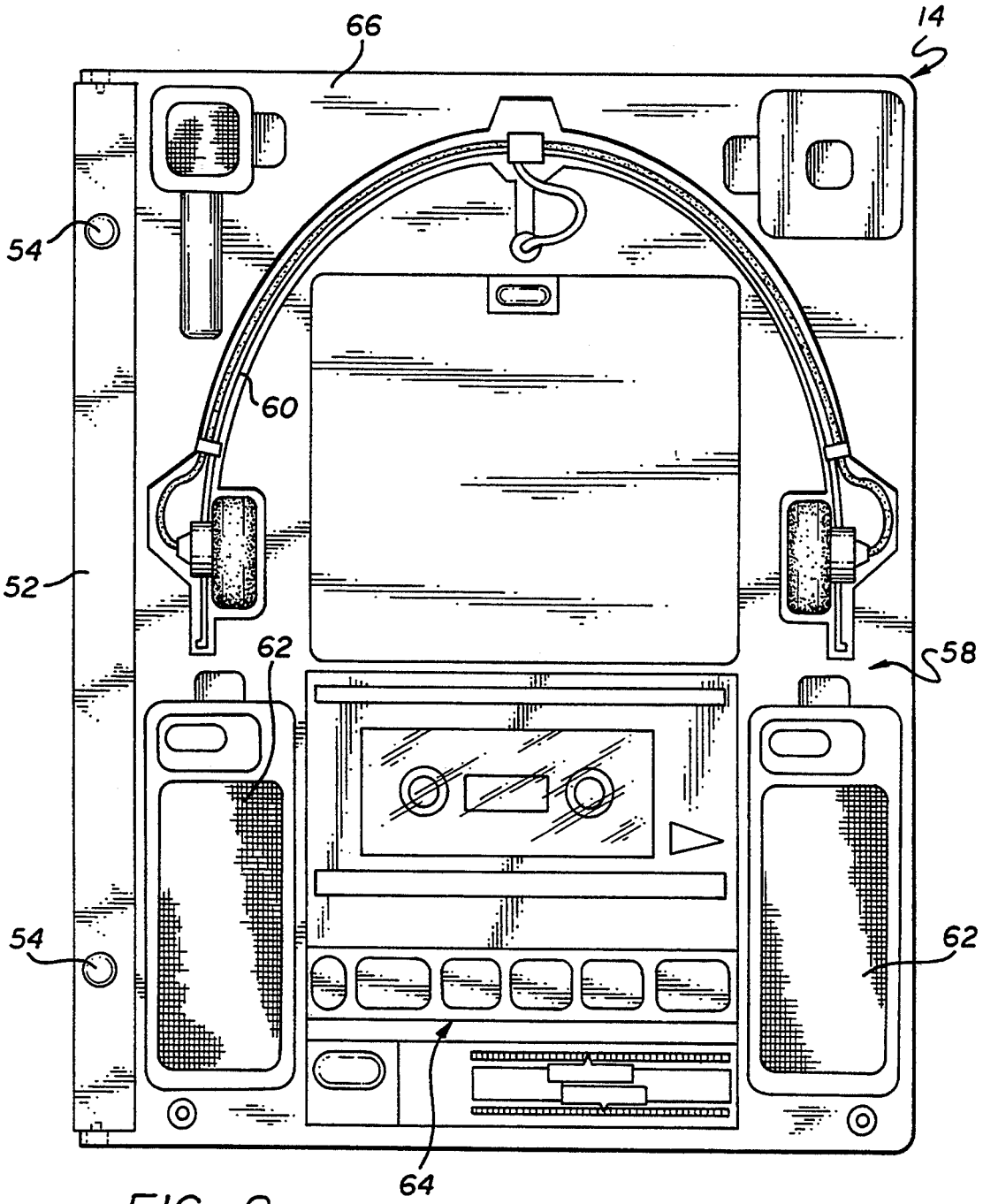
FIG. 8

MODULAR BOOK BINDER

BACKGROUND OF THE INVENTION

This invention relates generally to a modular binder for quickly and easily binding a sheaf of loose-leaf papers to form a book. More particularly, this invention relates to an improved binder assembly constructed from a relatively small number of cost-efficient binder components adapted to accommodate variable thickness of the bound paper sheaf, and further adapted for use in combination with auxiliary communication and/or entertainment modules.

Loose-leaf binders are generally known in the art for use in receiving and retaining a sheaf of papers in an organized, orderly fashion. As one common example, conventional ring binders include a plurality of metal or plastic rings for reception through preformed perforations along one side edge of a sheaf of papers. Such ring binders are used extensively in applications wherein frequent insertion and/or removal of paper sheets from the binder is necessary or desirable. However, such binders exhibit a fixed width or thickness at the binder spine, in accordance with the size of the binder rings, in combination with a variable width or thickness at the open side of the binder in accordance with the number of contained pages. As a result, traditional ring binders do not have a uniform rectangular book-like configuration, and thus are not conducive to stacking or shelving in an orderly manner. Moreover, individual sheets contained within the binder are subject to relatively easy inadvertent tearing from the binder rings.

Alternative binder constructions have been proposed for receiving a variable thickness stack of papers with one side edge clamped securely within the spine of an adjustable binder cover. See, for example, the variable thickness binder constructions described in U.S. Pat. Nos. 758,292; 1,101,780; 2,472,969; 3,734,634; and 4,730,950. While these binder constructions beneficially accommodate compilation and binding of papers into a more rectangular book-like configuration, with reduced risk of inadvertent tearing of individual sheets from the binder, these binder constructions require multiple cover components and/or multiple paper retainer pins and related clamp or lock devices which result in a relatively complex and costly binder product.

The present invention provides an improved and simplified binder construction of modular design, wherein the binder is formed from a relatively minimum number of components adapted for cost-efficient manufacture by plastic molding or the like, and for securely receiving and binding a sheaf of papers. The improved modular binder of the present invention is further adapted for use in combination with auxiliary communication and/or entertainment modules to expand the versatility and use of the binder product.

SUMMARY OF THE INVENTION

In accordance with the invention, an improved modular binder is provided for quickly and easily binding a sheaf of papers to form a book, wherein the binder components are adapted for adjustable interlocking engagement to accommodate the thickness of the paper sheaf. The modular binder comprises a pair of cover modules which can be formed as identical plastic moldings each to include a cover leaf hinged to a spine segment. The two spine segments include interfitting alignment members to insure correct assembly thereof, in combination with a plurality of retainer pins for reception through preformed perforations located along one side of the pages constituting the paper sheaf. A spine lock clip is provided for removable snap-fit mounting onto the spine segments to retain the spine segments in interlocked relation.

More specifically, in the preferred form of the invention, each cover module is formed as a unitary plastic molding to include the cover leaf having a size and shape to overlie and protect the sheaf of papers. The cover leaf is joined along one side edge by a living hinge to the associated spine segment. The spine segment includes a plurality of the paper retainer pins positioned for reception through the preformed perforations along the side edge of the paper sheaf. The spine segment also includes said alignment members in the form of a plurality of alignment keys in combination with a corresponding plurality of key-receiving alignment tracks. When a pair of the cover modules are assembled in face-to-face relation, the retainer pins of the two spine segments fit through the perforations in the paper sheaf, and the alignment keys of one spine segment are positioned for slide-fit engagement with the alignment tracks of the other spine segment.

The spine lock clip is removably connected to the assembled spine segments to form the modular binder. The spine lock clip, in the preferred form, has a size and shape to overlie an outboard side edge of the assembled spine segments, and is preferably formed as a transparent plastic molding such that a title label or the like may be mounted at an inboard side of the lock clip for external viewing. The lock clip has a plurality of inwardly protruding lock ribs formed thereon for reception into selected ones of a plurality of spacer slots formed in the assembled spine segments to lock the spine segments in assembled relation. The particular spacer into which the lock ribs are received will vary according to the thickness of the paper sheaf. Snap-fit lock fingers on the lock clip engaged with the spine segments to secure the lock clip onto the spine segments.

In preferred variations of the invention, the cover modules are adapted for removable mounting of one or more auxiliary communication and/or entertainment modules provided to expand the utility and versatility of the binder product. Exemplary auxiliary modules include an audio tape player and components thereof installed within a low profile housing having snap tabs for snap-fit reception into mating detents formed in the spine segment of one of the cover modules. Additional auxiliary modules may include, for example, similarly constructed housings for containing audio tapes, video tapes, pencils and other writing accessories, etc.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view illustrating a modular book bin bodying the novel features of the invention;

FIG. 2 is an exploded perspective view illustrating components of the modular binder depicted in FIG. 1;

FIG. 4 is a bottom edge view illustrating the module binder in assembled form, with one or auxiliary module assembled therewith;

FIG. 5 is an enlarged fragmented vertical sectional view taken generally on the line 5—5 of FIG. 4;

FIG. 6 is an enlarged fragmented horizontal sectional view taken generally on the line 6—6 of FIG. 5;

FIG. 7 is an enlarged fragmented vertical sectional view similar to FIG. 5, and illustrating the binder assembled with a sheaf of papers of different thickness;

FIG. 8 is a plan view depicting one form of an auxiliary module for use with the invention;

DETAILED DESCRIPTION OF THE PREFERRED EMBODIMENT

Figure 3:
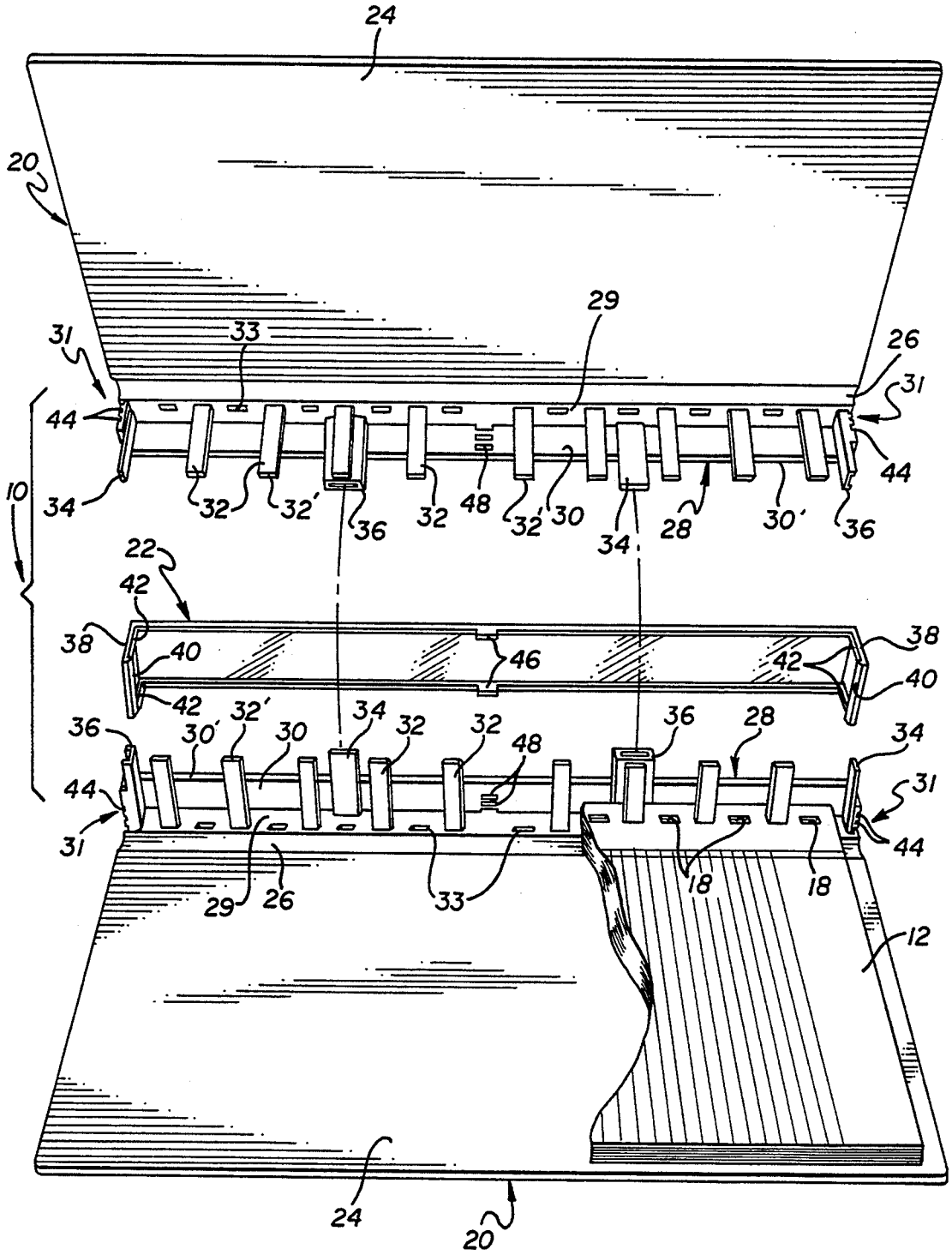
FIG. 3 is an exploded perspective view illustrating assembly of a pair of cover modules with a spine lock clip to form the modular binder.

As shown in the exemplary drawings, a modular binder referred to generally by the reference numeral 10 is provided for quickly and easily binding a sheaf of papers 12 to form a book. The binder 10 is constructed from a relatively small number of modular components adapted for variable assembly to accommodate variable thickness of the paper sheaf 12. In addition, the assembled binder 10 may be used in combination with one or more auxiliary modules identified in FIGS. 1 and 2 by reference numerals 14 and 16, wherein such auxiliary modules are provided to expand or enhance the utility and versatility of the binder product.

The modular binder 10 is designed for use with conventional paper sheets or pages of the type having a row of preformed holes or perforations 18 along one side edge, as shown in FIG. 3. In this regard, the sheaf 12 of individual paper sheets may be ruled or unruled, or may contain preprinted textual information, or otherwise comprise an assembly of blank pages for use in note-taking, etc. In the preferred form and use of the modular binder 10, the paper sheaf 12 comprises a sequence of pages containing printed textual information of the type generated, for example, in a desktop publishing application. Importantly, the number of individual pages and thus the thickness of the paper sheaf 12 may vary within a substantial range of thicknesses, with the modular components of the binder 10 being adapted for adjustable interconnection to accommodate the thickness of the paper sheaf while providing a secure and stable binder construction which retains the pages in a substantially rectangular, book-like configuration conducive to organized and orderly stacking and/or shelving.

As shown best in FIGS. 2 and 3, the basic modular binder 10 generally comprises a pair of cover modules 20 adapted for assembly in face-to-face relation to receive and retain the paper sheaf 12, in combination with a spine lock clip 22 for securely but removably interconnecting the two cover modules 20. The cover modules 20 and the spine lock clip 22 are preferably constructed as relatively inexpensive and lightweight plastic moldings. In addition, the preferred cover modules 20 are designed to be identical, yet interfit with each other when assembled in face-to-face relation as shown. Thus, in the preferred form, the modular binder 10 requires manufacture of two different pieces, namely, the cover module 20 and the spine clip 22, to form the binder product.

Each cover module 20 comprises a cover leaf 24 joined along one side edge by a flexible living hinge 26 to a spine segment 28. The overall size and shape of the cover leaf 24 and the spine segment 28 are adapted to cover and protect the paper sheaf 12, such as perforated paper sheets of a standard production size, for example, letter-sized paper. The cover leaf 24 can be formed to have a relatively rigid structure to provide a hard-bound cover for the book to be assembled, or, in the alternative, the cover leaf 24 may have a relatively stiff but flexible construction to provide a soft-bound cover. The spine segment 28, however, has a relatively rigid construction.

The spine segment 28 of each cover module 20 includes a base strip 29 joined to the hinge 26 at a position directly opposite to the associated cover leaf 24. A short upstanding spine wall 30 is formed on the base strip to extend along an outboard edge of the spine segment. As shown best in FIG. 3, the opposite ends of the spine wall 30 at the top and bottom edges of the spine segment 28 are turned inwardly and terminate in upstanding lock surfaces 31 disposed in close proximity with the hinge 26.

A row of paper retainer pins 32 project upwardly from the base strip 29 of each spine segment 28, wherein this row of pins 32 is formed at a position spaced inboard from the spine wall 30 and in close proximity to the hinge 26. The illustrative retainer pins 32 have a blade-like rectangular cross-section sized for slide-fit reception through the perforations 18 in the paper. As shown, the retainer pins 32 are provided for reception through every other one of the perforations 18, with shallow rectangular recesses 33 being formed between alternate retainer pins 32.

With this arrangement, when a pair of the cover modules 20 are assembled with their respective spine segments 28 in face-to-face relation, as viewed in FIG. 3, the cover leaves 24 of the two cover modules respectively define the front and back covers of a book. The retainer pins 32 of one cover module project into the spaces between the retainer pins 32 of the second cover module, such that all or substantially all of the paper perforations 18 are occupied by a retainer pin 30. When the thickness of the paper sheaf 12 according to the number of papers therein, is equal to or less than the height of the retainer pins 32, the free ends 32' of the retainer pins on each cover modules seat within the pin recesses 33 on the other cover module (FIG. 5). In this geometry, the spine walls 30 of the assembled cover modules are positioned with their edge margins 30' substantially in line or edge-to-edge contact with each other. However, when the thickness of the paper sheaf 12 is greater than the height of the retainer pins 32, the pin free ends 32' are spaced from the pin recesses 33 (FIG. 7). In this latter configuration, the two sets of retainer pins 32 on the two cover modules 20 collectively retain the paper sheaf 12 in the desired assembled and aligned organized fashion, provided that the thickness of the paper sheaf does not exceed twice the height of the retainer pins 32.

Each spine segment 28 additionally includes a plurality of upstanding alignment keys 34 and a corresponding plurality of upstanding key-receiving alignment tracks 36. In this regard, as shown in one form in FIG. 3, one alignment key 34 is positioned at one end of the spine segment 28, and one alignment track 36 is positioned at the opposite end of the same spine segment. An additional alignment key 34 and track 36 are formed in spaced relation along the rear edge of the spine segment 28, at the inboard side of the spine wall 30. With this configuration, the two alignment keys 34 on each spine segment are positioned for slide-fit engagement with the two alignment tracks 36 on the other spine segment 28, when the two cover modules 20 are assembled in face-to-face relation. These alignment keys 34 and key-receiving tracks 36 assure correct interfitting engagement between the cover modules 20 for correctly positioning the paper retainer pins 32 in registry with the perforations 18 in the paper sheaf 12, as previously described.

The slide-fit engagement between the alignment keys 34 and the alignment tracks 36 on the two spine segments accommodates the sheaf 12 within a significant range of thicknesses. That is, the alignment keys 34 are substantially fully received into the key tracks 36 when the sheaf thickness is equal to or less than the height of the paper retainer pins 32 (FIG. 5). Alternately, when the sheaf thickness is greater than the height of the retainer pins 32, but less than the pin height, the keys 34 are partially received into the associated key tracks 36 (FIG. 7).

The spine lock clip 22 is provided for quickly and easily interconnecting the two cover modules 20 in assembled relation with the paper sheaf 12. As shown, the lock clip 22 comprises an elongated and generally rectangular spine element having a size and shape to overlie the outboard side edges of the spine segments 28, wherein the lock clip 22 includes inwardly protruding feet 38 at its opposite ends for snap-fit locking engagement with the spine segments. More particularly, the feet 38 each include a wedge-shaped lock finger 40 adapted for snap-fit engagement with the lock surfaces 31 on the spine walls 30 of the assembled spine segments 28 (FIGS. 3 and 6). Moreover, these inturned lock feet 38 include inturnal ribs 42 for slide-fit reception into one of a plurality of parallel retainer slots 44 formed in the alignment keys 34 and tracks 36 (FIGS. 3, 5 and 7). Additional internal lock ribs 46 may be provided at a central location along the lock clip 22 for reception into correspondingly positioned slots 48 formed in the upstanding spine walls 30 of the spine segments 28. The specific slots 44 and 48 into which these lock ribs 42, 46 are respectively received will vary according to the thickness of the paper sheaf 12, wherein an exemplary slot spacing will accommodate a range of sheaf thickness in increments of about one-eight inch.

Figure 10:
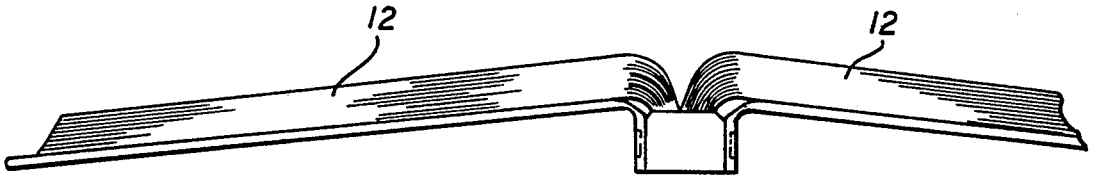
FIG. 10 is a bottom edge view of the assembled modular binder, in an open configuration and omitting installation of auxiliary modules.

The resultant modular binder 10 provides a secure and stable structure for receiving and retaining the paper sheaf 12. The assembled binder product essentially comprises a hard-bound book structure of selected size and uniform rectangular profile for facilitated and organized stacking and/or shelving. The bound paper sheets are securely retained in a manner permitting relatively free turning in any open position (FIG. 10) with the perforated side edge of the sheaf securely retained to minimize or eliminate inadvertent tearing of paper sheafs from the binder products. In a preferred form, the spine lock clip 22 is formed from a transparent material to permit external viewing of the title label 50 (FIG. 1) retained between the lock clip 22 and the spine segments 28.

In accordance with further aspects of the invention, one or more of the auxiliary modules 14 and 16 may be removably mounted onto the cover modules 20 for purposes of expanding the versatility and utility of the binder product. Each auxiliary module may include a spine block 52 having a pair of snap tabs 54 adapted for removable snap-fit reception into a correspondingly positioned pair of snap-tab detents 56 formed in the spine segments 28 of the cover modules 20. With this construction, as shown clearly in FIGS. 1 and 2, the modules 14 and/or 16 may be removably installed to the binder 10. In one preferred form, the use of one or more of the auxiliary modules 14, 16, provides a desirable multimedia product.

Figure 9:
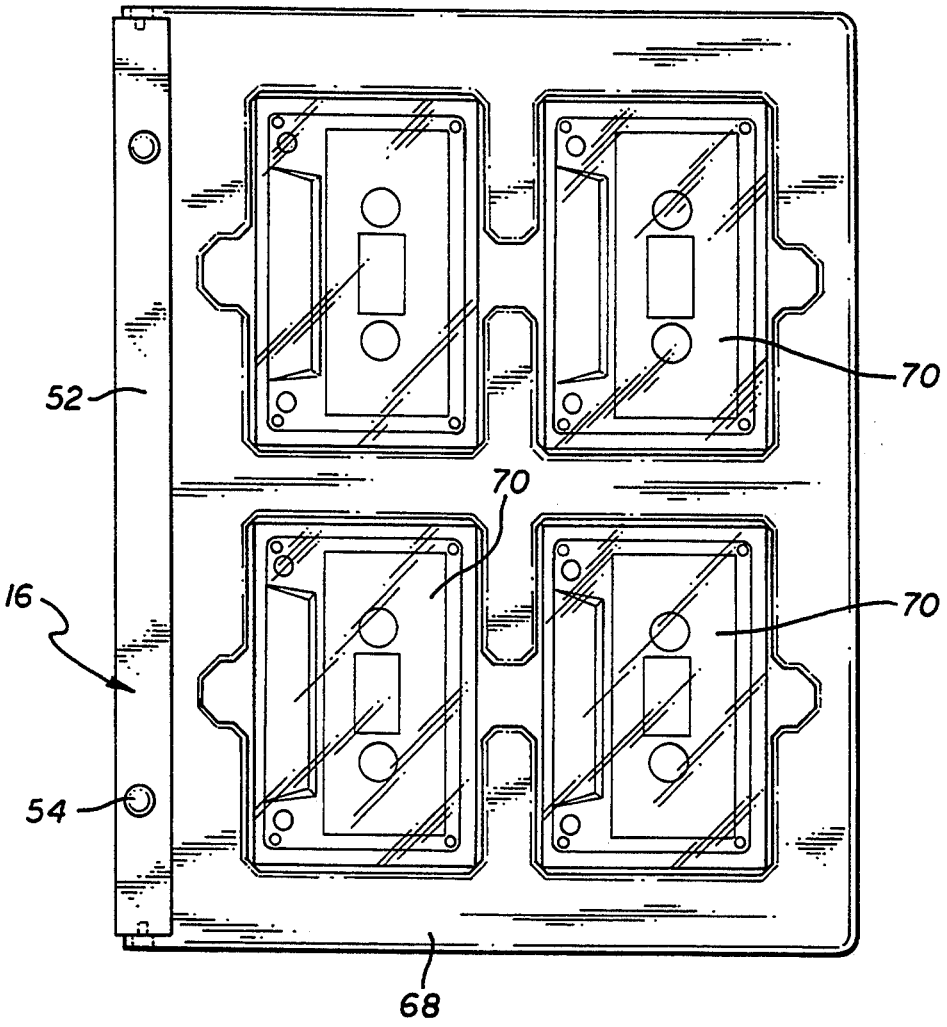
FIG. 9 is a view depicting another form of an auxiliary module for use with the invention.
Figure 11:
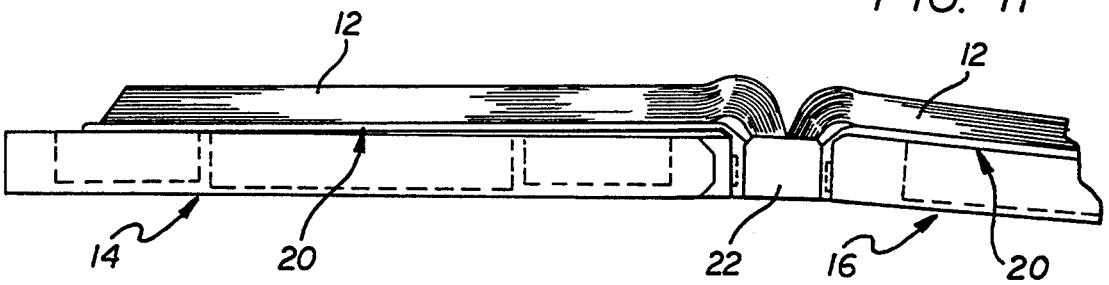
FIG. 11 is a bottom edge view of the modular binder in an open configuration, and including a pair of auxiliary modules.

More particularly, with reference to FIGS. 8, 9 and 11, the auxiliary module 14 may comprise an audio cassette player 58 including appropriate components such as a headset 60 and speakers 62 with appropriate accessible controls 64. This module 14 may be used with a cassette tape having information associated with the textual materials bound into the binder 10, thereby permitting the user to read along and/or otherwise obtain additional information or educational experience in coordination with the textual materials. The auxiliary module 14 may comprise a housing 66 hinged to the spine block 52 and adapted to receive and support the components of the tape player 64. A second module 16 (FIG. 9) may be provided in the form of a housing 68 adapted to receive and store several tape cassettes 70. Both modules 14 and 16 may remain mounted to the binder 10 as the components thereof are used, as shown in FIG. 11.

The improved modular binder 10 of the present invention thus provides a simple and cost-efficient apparatus and method for securely binding a sheaf papers which may have a variant thickness. The binder is particularly suited for use with other communication and/or entertainment devices such as tape players, and the like. Alternative auxiliary modules may include means for carrying and storing writing implements and other related materials, video tape carriers, computer disk carriers, and so forth.

A wide variety of further modifications and improvements to the invention described herein will be apparent to those skilled in the art. Accordingly, no limitation on the invention is intended by way of the foregoing description and accompanying drawings, except as set forth in the appended claims.

What is claimed is:

1. A modular binder for receiving and retaining a sheaf of papers having a plurality of perforations formed along one side edge thereof, said modular binder comprising:

a pair of cover modules each including a cover leaf and a spine segment interconnected by a hinge;

said spine segments each including a plurality of retainer pins for reception through the perforations in the paper sheaf, and alignment means for aligned interfitting assembly of the spine segments in face-to-face relation with said retainer pins received through the sheaf perforations to retain the sheaf between the assembled cover modules; and a spine lock clip for interconnecting said spine segments to bind the paper sheaf between the cover modules, said spine lock clip and said spine segments having interengageable ribs and slots for interconnecting said spine segments at a selected one of a plurality of different spacings between said spine segments in accordance with the thickness of the paper sheaf.

2. The modular binder of claim 1 wherein the spine lock clip is removably mounted to said spine segments.

3. The modular binder of claim 1 wherein said cover modules are identical.

4. The modular binder of claim 1 wherein said cover modules comprise an identical pair of plastic moldings.

5. The modular binder of claim 1 wherein said alignment means comprises at least one alignment key and at least one key-receiving alignment track formed on each of said spine segments, said alignment key on each of said spine segments being slidably receivable into said alignment track on the other of said spine segments when said spine segments are assembled in face-to-face relation.

6. The modular binder of claim 1 wherein said retainer pins on each of said spine segments are positioned for reception through alternate ones of the perforations formed in the paper sheaf.

7. The modular binder of claim 1 wherein said spine segments each define a plurality of said slots oriented in a generally parallel array, and wherein said spine lock clip includes said ribs for reception into said slots.

8. The modular binder of claim 7 wherein said ribs are formed on said spine lock clip in pairs with each pair of said ribs being respectively engageable with a selected pair of said slots defined by the two spine segments.

9. The modular binder of claim 1 wherein said spine lock clip comprises a plastic molding.

10. The modular binder of claim 1 wherein said spine lock clip is formed from a transparent material.

11. The modular binder of claim 1 further including an auxiliary module defining a housing adapted to receive and store selected items correlated with information carried by the paper sheaf, and means for mounting said auxiliary module to the spine segment of one of said cover modules.

12. The modular binder of claim 11 wherein said mounting means comprises snap-fit mounting members formed respectively on said auxiliary module and on the spine segment of said one cover module.

13. The modular binder of claim 11 further including a second auxiliary module defining a housing adapted to receive and store selected items correlated with information carried by the paper sheaf, and means for mounting said second auxiliary module to the spine segment of the other of said cover modules.

14. A modular binder for receiving and retaining a sheaf of papers, said modular binder comprising:

a pair of cover modules each including a cover leaf and a spine segment interconnected by a hinge;

said spine segments including alignment means for aligned interfitting assembly thereof in face-to-face relation, said spine segments further including means for retaining one side edge of the sheaf of papers therebetween when said spine segments are assembled in face-to-face relation;

a spine lock clip for interconnecting said spine segments in face-to-face relation to bind the paper sheaf between said cover modules; and an auxiliary module defining a housing adapted to receive and store selected items correlated with information carried by the paper sheaf, and means for mounting said auxiliary module to the spine segment of one of said cover modules.

15. The modular binder of claim 14 wherein said mounting means comprises snap-fit mounting members formed respectively on said auxiliary module and on the spine segment of said one cover module.

16. The modular binder of claim 14 further including a second auxiliary module defining a housing adapted to receive and store selected items correlated with information carried by the paper sheaf, and means for mounting said second auxiliary module to the spine segment of the other of said cover modules.

17. The modular binder of claim 14 wherein said cover modules are identical.

18. The modular binder of claim 14 wherein said alignment means comprises at least one alignment key and at least one key-receiving alignment track formed on each of said spine segments, said alignment key on each of said spine segments being slidably receivable into said alignment track on the other of said spine segments when said spine segments are assembled in face-to-face relation.

19. The modular binder of claim 14 wherein said spine lock clip and said spine segments have interengageable ribs and slots for interconnecting said spine segments at a selected one of a plurality of different spacings between said spine segments in accordance with the thickness of the paper sheaf.

20. A modular binder for receiving and retaining a sheaf of papers having a plurality of perforations formed along one side edge thereof, said modular binder comprising:

a pair of unitary and substantially identical cover modules each including a cover leaf and a spine segment interconnected by a hinge;

said spine segments each including a row of retainer pins for reception through alternate ones of the perforations in the paper sheaf, said spine segments being adapted for assembly in face-to-face relation with the one side edge of the paper sheaf disposed therebetween, whereby said retainer pins of both of said spine segments are received into substantially all of the perforations in the paper sheaf;

said spine segments each further including a plurality of alignment keys and a plurality of key-receiving alignment tracks, whereby the alignment keys on one of said spine segments are slidably receivable into the alignment tracks on the other of said spine segments when said spine segments are assembled in face-to-face relation;

said spine segments also defining a plurality of generally parallel lock rib slots; and a spine lock clip including at least one pair of lock ribs for reception into a selected pair of said lock rib slots located respectively on both spine segments for interconnecting said spine segments at a selected spacing according to the thickness of the paper sheaf, said lock clip further including means for removably retaining said lock clip on said spine segments.

21. The modular binder of claim 20 further including an auxiliary module defining a housing adapted to receive and store selected items correlated with information carried by the paper sheaf, and means for mounting said auxiliary module to the spine segment of one of said cover modules.

22. The modular binder of claim 21 wherein said mounting means comprises snap-fit mounting members formed respectively on said auxiliary module and on the spine segment of said one cover module.

23. The modular binder of claim 21 further including a second auxiliary module defining a housing adapted to receive and store selected items correlated with information carried by the paper sheaf, and means for mounting said second auxiliary module to the spine segment of the other of said cover modules.

* * * * *